US007845921B2

(12) United States Patent
Prior

(10) Patent No.: US 7,845,921 B2
(45) Date of Patent: Dec. 7, 2010

(54) SUPERCHARGER WITH OUTLET BARS FOR ROTOR TIP SEAL SUPPORT

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 473 days.

(21) Appl. No.: 12/048,259

(22) Filed: Mar. 14, 2008

(65) Prior Publication Data

US 2009/0232689 A1 Sep. 17, 2009

(51) Int. Cl.
*F03C 2/00* (2006.01)
*F03C 4/00* (2006.01)
*F04C 18/00* (2006.01)

(52) U.S. Cl. ..... 418/206.4; 418/104; 418/109; 418/140; 418/143; 418/206.1

(58) Field of Classification Search ..... 418/104, 418/109, 113, 140, 141, 143, 201.1, 206.1, 418/206.4–206.6; 123/559.1
See application file for complete search history.

(56) References Cited

U.S. PATENT DOCUMENTS 2,463,080 A * 3/1949 Beier ..... 418/206.6
2,572,334 A * 10/1951 Guibert ..... 418/206.5
2,667,046 A * 1/1954 Densham ..... 418/206.4
4,564,346 A * 1/1986 Kimmons et al. ..... 418/206.5
4,609,335 A * 9/1986 Uthoff, Jr. ..... 418/206.4
5,078,583 A * 1/1992 Hampton et al. ..... 418/206.5
6,589,034 B2 * 7/2003 Vorwerk et al. ..... 418/206.4
6,874,486 B2 * 4/2005 Prior et al. ..... 418/206.2
6,884,050 B2 * 4/2005 Prior ..... 418/201.1

* cited by examiner

*Primary Examiner*—Theresa Trieu

(57) ABSTRACT

The invention is to reduce flutter and wear and improve the serviceability and wear life of tip seals for roots blower and screw type compressor superchargers where used for improved supercharger output and efficiency. As the seals travel over the outlet opening, the seals move outward in their slots, leading to flutter which may shorten their useful lives. As each seal reaches the center of the outlet opening, it is forced back into its groove by engaging a valley of the mating rotor with the likelihood of increased wear. The invention provides longitudinally spaced support bars extending laterally across the opening in the directions of rotation of the rotors. The support bars have inner surfaces machined with the associated rotor cavity bores and thus smoothly support the seals as they ride over the support surfaces. The support reduces the flexing of the seals and the resultant wear. Each seal contacts a support bar only during inward motion to the center of the opening where the machined bores intersect and the seal is moving into a valley of the associated rotor of the pair. To reduce edge effect wear of the seals, the width of the support bars may be made narrower from the outer edges of the outlet opening to the center, where each seal loses contact with its respective support bar.

5 Claims, 3 Drawing Sheets

SUPERCHARGER WITH OUTLET BARS FOR ROTOR TIP SEAL SUPPORT

TECHNICAL FIELD

This invention relates to positive displacement air pumps or superchargers, such as roots type blowers or screw compressors utilized for automotive engine superchargers and other purposes.

BACKGROUND OF THE INVENTION

It is known in the art to utilize positive displacement superchargers having lobed rotors for supercharging internal combustion engines and for providing compressed air for other purposes. Such a positive displacement supercharger used as an automotive supercharger may include a housing having a rotor cavity in which a pair of parallel rotors having interleaved lobes rotate to compress air drawn into one end of the housing and discharged through an opening in the cavity wall near an opposite end of the housing. The rotors may be belt driven by the engine through a pulley, or through a gear train, connected directly to the pair of rotors.

Superchargers are very sensitive to running clearances. Tighter clearances between the two rotors and between the rotors and the rotor cavity wall improve flow and efficiency by reducing leakage of hot boost air to the intake side. Problems with scuffing limit the tightest practical operating clearances that are possible. Scuffing is more likely to occur during continuous high load operation from thermal growth resulting from high outlet air temperatures. Rotor fits generally compromise efficiency to maintain clearance and prevent scuffing.

In high performance and racing engines, flexible tip seals are sometimes applied along the outer edges of the rotors to seal the clearances and provide improved performance and efficiency. However, short wear life generally makes these applications unsuitable for use in general production vehicles.

SUMMARY OF THE INVENTION

The present invention is proposed to improve the serviceability and wear life of tip seals for roots blower and screw type compressor superchargers. Such tip seals may be made of PTFE or other flexible materials having toughness and durability. However operating conditions in the rotor chamber may contribute to flutter and wear which shorten the operating life of the seals. The air outlet opening from the rotor chamber may be generally triangular, having a base adjacent the outlet end of the housing and angled sides leading to a peak spaced from the base of the triangle opposite to the direction of air flow in the housing. In operation, as the seals travel over the outlet opening, the seals move outward in their slots leading to flutter which may shorten their useful lives. As each seal again reaches the center of the outlet opening, it moves from the housing periphery to the recess, or valley, between the associated lobes and is forced back into its groove with the likelihood of increased wear.

The invention reduces the flutter and wear of the seals at the outlet opening by providing longitudinally spaced support bars extending laterally across the opening in the directions of rotation of the rotors. The support bars have inner surfaces machined with the associated rotor cavity bores and thus smoothly support the seals as they ride over the support surfaces. The support reduces the flexing of the seals and the resultant wear at the edges of the outlet opening. Each seal contacts a support bar only during inward motion to the center of the opening where the machined bores intersect and the seal is moving into a valley of the associated rotor of the pair. Thus, to reduce edge effect wear of the seals, the width of the support bars is made narrower from the outer edges of the outlet opening to the center, where each seal loses contact with its respective support bar.

These and other features and advantages of the invention will be more fully understood from the following detailed description of exemplary embodiments taken together with the accompanying drawings

DESCRIPTION OF AN EXEMPLARY EMBODIMENT

Figure 1:
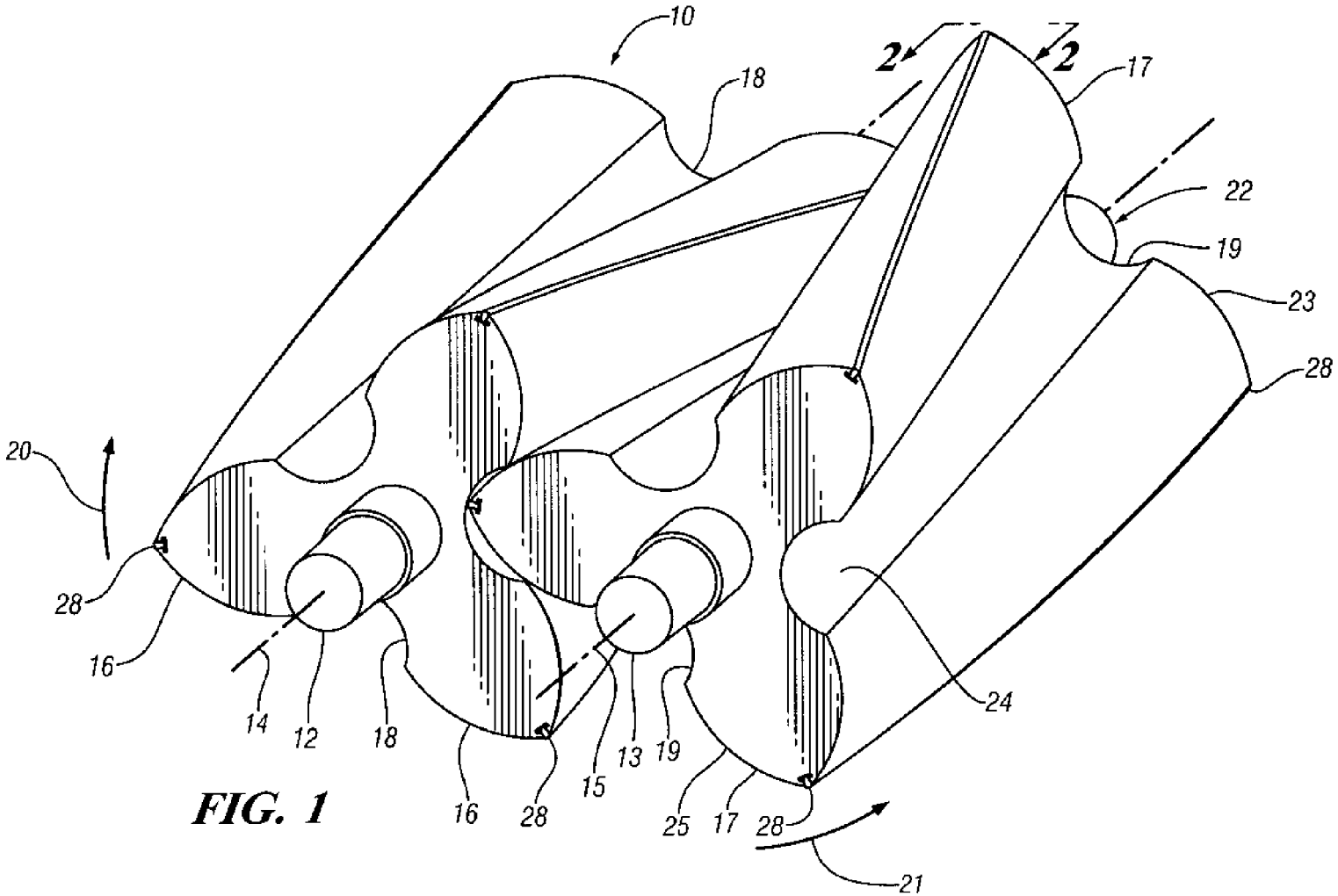
FIG. 1 is a pictorial view of a rotor set with interleaved rotors having tip seals for a supercharger according to the invention.
Figure 2:
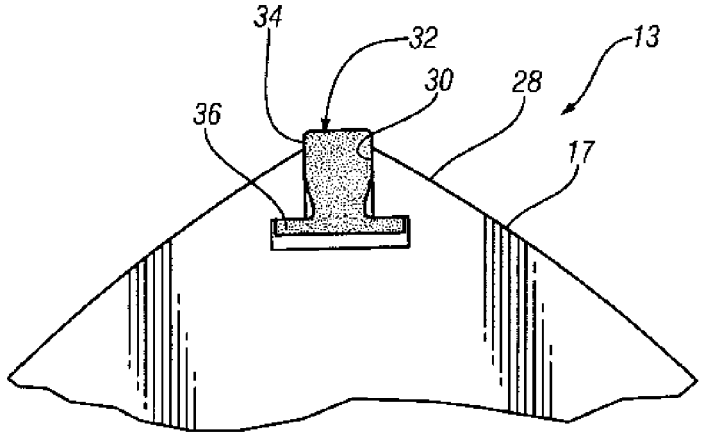
FIG. 2 is an end view in the direction of the arrows from the line 2-2 of FIG. 1, illustrating the seal and groove configuration.

Referring first to FIGS. 1 and 2 of the drawings in detail, numeral 10 generally indicates a rotor set for a positive displacement supercharger of a known roots type. The set comprises dual rotors 12, 13 rotatable on parallel axes 14, 15. The rotors have helical lobes 16, 17 of opposite hand with alternating valleys 18, 19, respectively, shown interleaved in their use position as in a housing. Rotation in respective clockwise and counterclockwise directions, as shown by arrows 20, 21 in FIG. 1 of the drawings, carries air between the lobes from an inlet 22 at the far end 23 to an outlet 24 adjacent the near end 25 of the rotors as shown in FIG. 1.

The radial outer ends or tips 28 of the rotor lobes 16, 17, shown also in FIG. 2, are provided with T-slots 30 in which flexible tip seals 32 are retained for sealing radial clearances between the rotors and an outer housing in which the rotor set may be installed. Each seal 32 has a T-shaped cross section with a sealing portion 34 extending through a narrow part of its slot for sealing engagement with a rotor cavity and a retaining portion 36 received in a wider part of the slot for retaining the seal in its slot. If desired, the seals 32 may be biased outward by springs, not shown, to the position shown in FIG. 2, or may rely on centrifugal force during rotation to force the seals outward. The seals may be made of polytetrafluoroethylene (PTFE) or any other suitable seal material.

Figure 3:
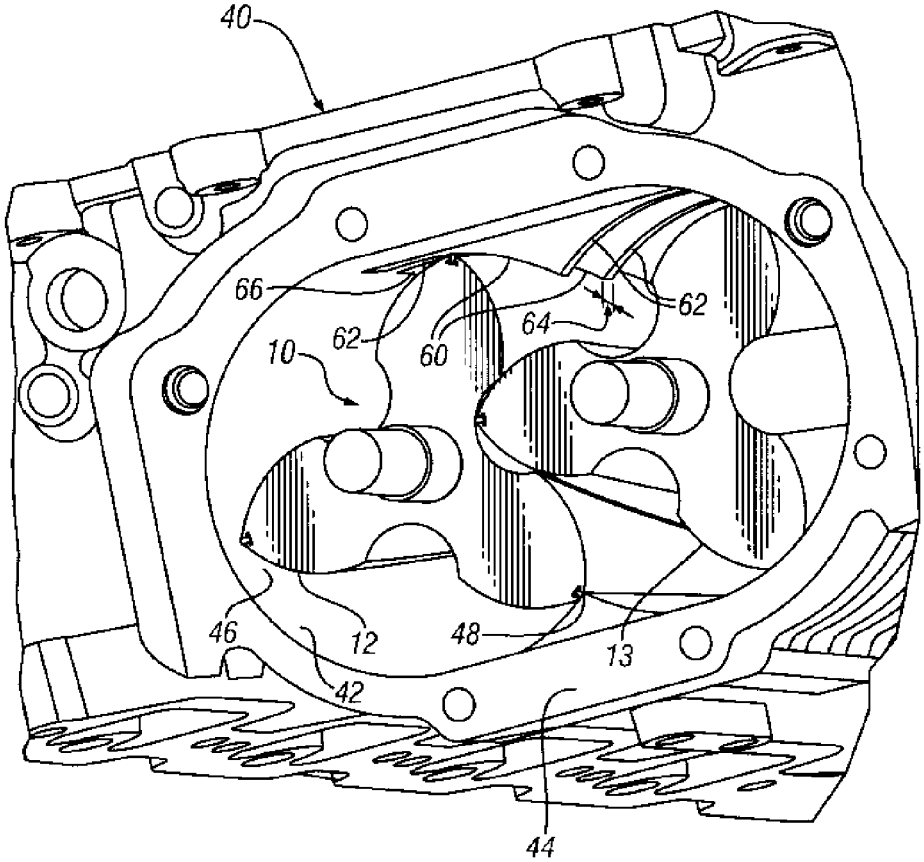
FIG. 3 is a pictorial view into the outlet end of a housing showing the rotors in a rotor cavity and transverse seal support bars according to the invention.

FIG. 3 shows the rotor set 10 installed within a housing 40 with the timing gear housing, not shown, removed to show the rotors 12, 13 in a rotor cavity 42 through the open outlet end 44 of the housing. The rotor cavity 42 is formed by a pair of parallel cylindrical bores overlapped to define a longitudinal cavity with a peripheral inner wall 46 having a necked-down cross-sectional shape 48 where the bores overlap similar to a FIG. 8.

Figure 4:
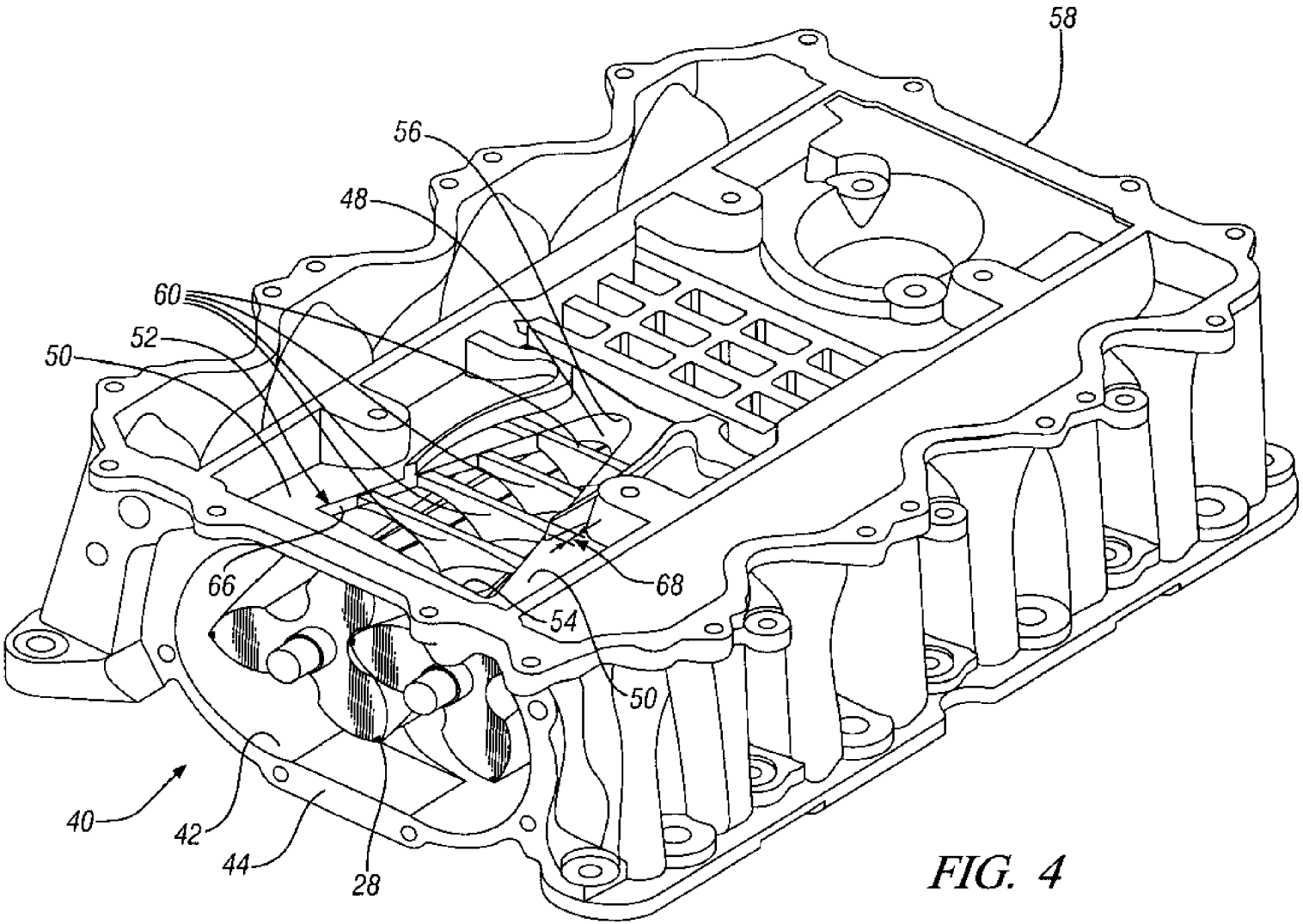
FIG. 4 is a pictorial view of the housing upper side showing the transverse seal support bars across the outlet opening adjacent the outlet end of the housing.

FIG. 4 shows an upper view of the housing 40 from the outlet end 44. An upper wall 50 of the housing 40 is provided with a triangular shaped outlet opening 52 having a wider end 54 of the triangle adjacent the housing outlet end 44 with the apex 56 of the triangle pointed toward the inlet end 58 of the housing. The outlet opening 52 extends laterally across the necked-down portion 48 of the cavity 42 from a small width at the apex 56 to a large width at the wider end 54 near the outlet end 44 of the housing.

In a conventional production supercharger without rotor tip seals, the outlet opening 52 may be a single triangular shaped hole. However, where rotor tip seals 32 are utilized, as may be done for racing or other purposes, passing of the rotor tips 28 over the opening 52 allows the tip seals 32 to move, under centrifugal force, slightly outward in the slots 30. They are then pushed back by engagement of the seals with valleys 18, 19 of the associated rotors, causing increased wear of the seals and possible early failure. The result is that the shorter life of the seals renders them impractical for conventional vehicle applications.

To improve the life of tip seals 32 used in supercharger applications, the outlet opening 52 is provided with support bars 60 extending laterally across the opening 52, in the direction of rotation of the rotor tips, at longitudinally spaced intervals along the opening 52. The bars 60 have inner surfaces 62 conforming with the shapes of the associated bore surfaces of the inner wall 46, so that the seals 32 are supported at intervals as they rotate with the rotors across the periphery of the outlet opening surfaces 62 formed by the bars. This reduces the outward movement and flutter of the seals 32 as they move across the outlet opening 52 to engage the valleys 18, 19 of the associated rotors near the midpoint of the outlet opening 52.

If desired, the bar inner surfaces 62 may have their widths 64 tapered inward from laterally outward edges 66 of the opening to the necked-down shape portion 48 of the cavity 42 to reduce edge wear of the seals as they travel along the bar inner surfaces 62 to the necked-down shape portion 48. Also, the widths 68 of the bars 60 may be tapered equally with the widths 64 of their inner surfaces 62 to minimize weight of the structure. When the housing is a casting, such as an aluminum casting, the bars may be formed and machined as part of the casting.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A positive displacement supercharger comprising:

a rotor housing including a rotor cavity formed with a pair of parallel cylindrical bores overlapping to define a longitudinal cavity with a peripheral inner wall having a necked-down cross-sectional shape where the bores overlap similar to a figure 8;

a pair of positive displacement rotors rotatable on parallel longitudinal axes within the rotor cavity, the rotors having interleaved lobes with outer tips rotatably facing opposed portions of the peripheral inner wall and cooperating valleys in the associated rotors operative to carry air longitudinally from an inlet end to an outlet end of the cavity, the lobes having lengthwise grooves extending along their outer edges and receiving flexible tip seals engaging the peripheral wall of the cavity and the cooperating recesses in the rotors to seal the rotor chambers and improve pumping efficiency;

an air inlet opening in the housing adjacent the inlet end of the cavity for admitting air into the rotor chambers;

an air outlet opening in the housing through the peripheral wall adjacent the outlet end of the cavity for discharging compressed air from the cavity, the outlet opening extending across a necked-down portion of the cavity near the outlet end of the cavity; and support bars extending laterally across the outlet opening at longitudinally spaced intervals and having inner surfaces conforming with the shapes of the associated bore surfaces, the bars supporting the seals as they rotate with the rotors across the periphery of the outlet opening surfaces formed by the bars to reduce outward movement and flutter of the seals as they move across the opening.

2. A supercharger as in claim 1 wherein the bar inner surfaces have their widths tapered inward from laterally outward edges of the opening to the necked-down portion of the cavity to reduce edge wear of the seats as they travel along the bar inner surfaces to the necked-down portion.

3. A supercharger as in claim 2 wherein the widths of the bars are tapered equally with the widths of their inner surfaces to minimize weight of the structure.

4. A supercharger as in claim 2 wherein the air outlet opening is generally triangular having a base adjacent the outlet end of the housing and angled sides leading to a peak spaced from the base of the triangle opposite to the direction of air flow.

5. A supercharger as in claim 1 wherein the housing is a casting and the bars are formed and machined as part of the casting.

* * * * *